United States Patent [19]

Satoh

[11] Patent Number: 5,063,479

[45] Date of Patent: Nov. 5, 1991

[54] ILLUMINATING SWITCH APPARATUS

[75] Inventor: Yukihiko Satoh, Furukawa, Japan

[73] Assignee: Alps Electric Co., Ltd., Tokyo, Japan

[21] Appl. No.: 580,404

[22] Filed: Sep. 7, 1990

[30] Foreign Application Priority Data

Dec. 11, 1989 [JP] Japan ..... 1-142033

[51] Int. Cl.[5] ..... F21V 8/00

[52] U.S. Cl. ..... 362/32; 362/95; 200/315

[58] Field of Search ..... 200/315, 313; 362/31, 362/26, 32, 800, 95

[56] References Cited

U.S. PATENT DOCUMENTS 3,598,950 8/1971 Ohashi ..... 200/315
4,124,879 11/1978 Schoemer ..... 362/26
4,177,501 12/1979 Karlin ..... 362/31
4,701,858 12/1987 Van Hout et al. ..... 200/315
4,710,602 12/1987 Baity et al. ..... 200/315

*Primary Examiner*—Ira S. Lazarus
*Assistant Examiner*—Sue Hagarman
*Attorney, Agent, or Firm*—Guy W. Shoup; David W. Heid

[57] ABSTRACT

A see-saw type illuminating switch apparatus having an illuminating portion provided on the upper surface of an operating portion, the apparatus having a light conduction body for conducting light of a light source, the light conduction body having a light issuing portion disposed in an oscillating direction of the operating portion under the operating portion, the operating portion being provided with a light conduction path leading to the upper surface thereof, the operating portion having a lower end formed into a forked configuration so as to ride on the light issuing portion.

4 Claims, 4 Drawing Sheets

ILLUMINATING SWITCH APPARATUS

BACKGROUND OF THE INVENTION

1. Field of the Invention

The present invention relates to an illuminating switch apparatus for illuminating the upper surface of an operating portion of a switch device.

2. Prior Art

Generally, an operating portion of a switch device, for example, of a power window switch of an automobile, is provided with an illuminating portion on the upper surface thereof to indicate its position when it is used in a dark place, or to indicate a state of operation FIG. 5 is an explanatory view showing a schematic structure of a conventional power window switch. In this figure, a knob 1 is rockably supported on a bearing portion 2 of a case. Pressing portions 1*a* and 1*b* of the knob 1 serve as illuminating portions, respectively. Light sources 3 and 3 are disposed below the pressing portions 1*a* and 1*b*, respectively.

FIG. 6 is an explanatory view showing a schematic structure of a further conventional power window switch. Reference numeral 4 designtes a bearing portion provided on the case; 5 a lever rockably supported on the bearing portion 4; 6 an LED mounted on the upper surface of the lever 5; and 7 a knob cover fitted in the lever 5.

Each of the above-described power window switches is illuminated by the light sources 3, 3 or LED 6. Although not shown, switch mechanims composed of movable contacts, fixed contacts and the like are activated and switched by the rocking motion of the knob 1 or the lever 5.

In the above-described prior art switches, the light sources 3 or the LED 6 are provided for each switch. Therefore, in the arrangement wherein a plurality of switches are disposed as in the power window switch, a mounting construction including a number of light sources 3 and LEDs 6 has to be provided, and many steps of mounting are required. In addition, the number of wirings used and connecting portions therefor increase, possibly lowering the reliability of the switch. Moreover, in the case where the LED 6 is used, replacement of LED alone cannot be made.

SUMMARY OF THE INVENTION

The present invention has been achieved in view of the problems encountered in the prior art switches. It is an object of the invention to provide an illuminating switch apparatus which can be simplified in construction, can be improved in reliability, and facilitate the replacement of light sources.

For achieving the aforementioned object, the present invention provides a see-saw type illuminating switch apparatus having an illuminting portion provided on the upper surface of an operating portion, in which the apparatus has a light conduction body for conducting light from a light source, a light issuing portion of said light conduction body being disposed to project light through the operating portion, said operating portion being provided with a light conduction path leading to the upper surface thereof, and the lower end of said operating portion is formed into a forked form such that the light issuing portion is disposed between the forks.

By the aforementioned means, illumination of a plurality of switch portions is effected by a single light source without provision of a light source for each switch portion. When the operating portion is rocked, the lower end of the operating portion is moved along the light issuing portion while riding the light issuing portion of the light conduction body. Even when the operating portion is rocked to a furthest allowable angle, light can be positively received from the light issuing portion. In this way, illumination at each of the oscillating operating portions is effected from a single light source installed externally of the operating portion.

BRIEF DESCRIPTION OF THE DRAWINGS

FIG. 1 is a plan view of an illuminating switch apparatus according to the present invention with a cover, a knob, a cover and the like removed;

FIG. 2 is a perspective view showing the state of an assembly of essential parts;

FIG. 3 is a perspective view of an assembled state;

FIG. 4 is an exploded perspective view; and

DETAILED DESCRIPTION OF THE INVENTION

Figure 1:
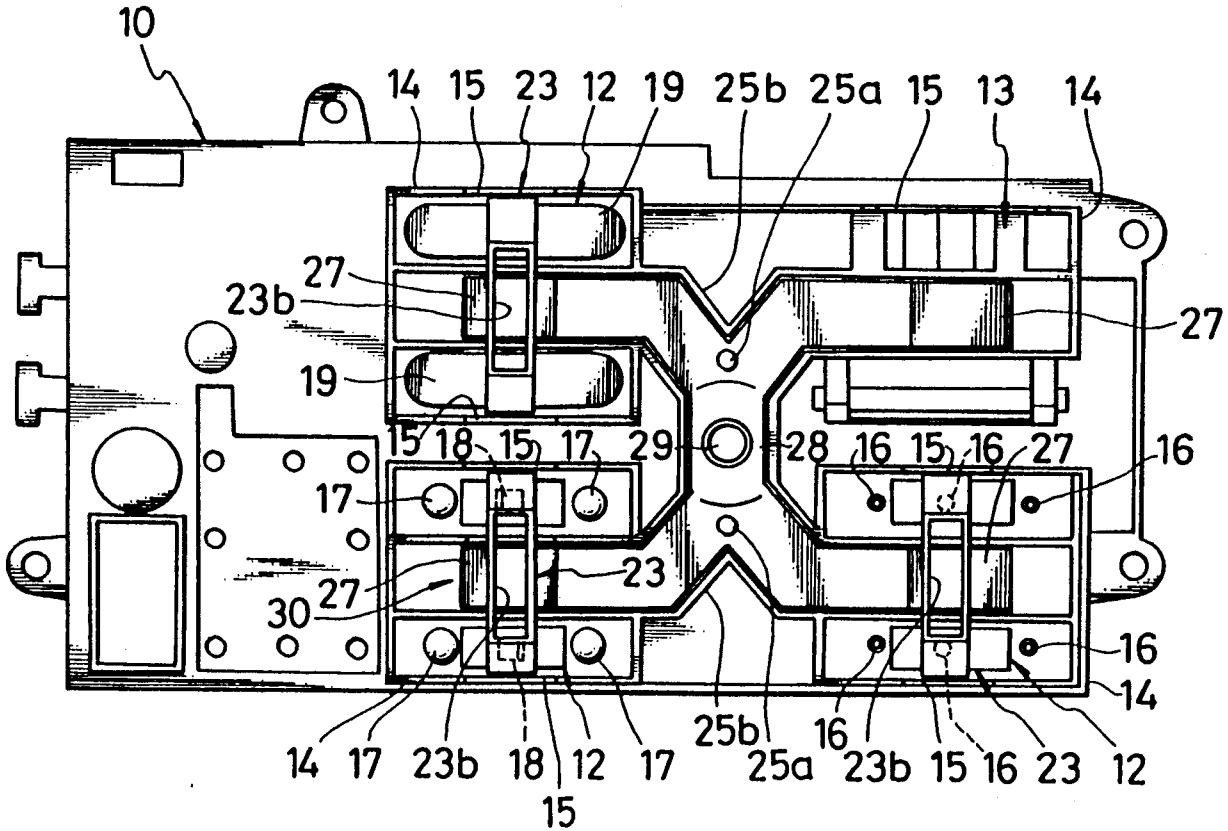
FIGS. 1 to 4 illustrate one embodiment of the present invention.
Figure 2:
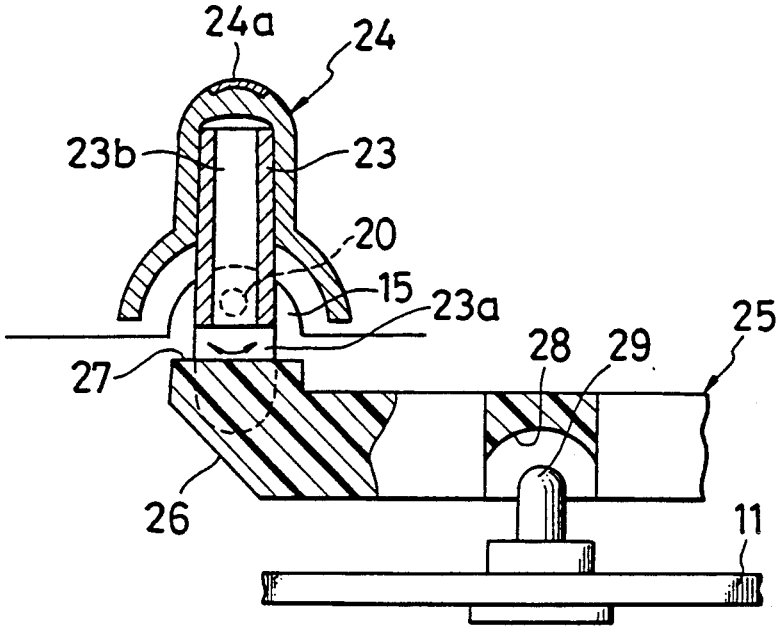
Figure 3:
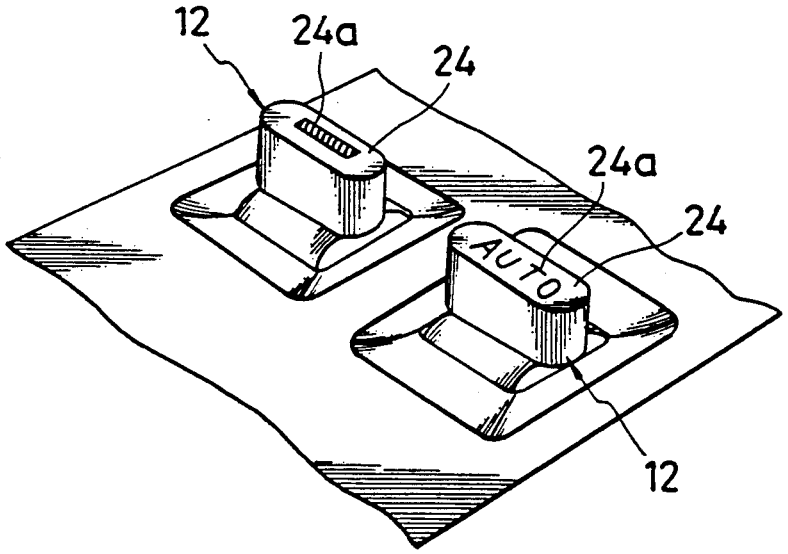
Figure 4:
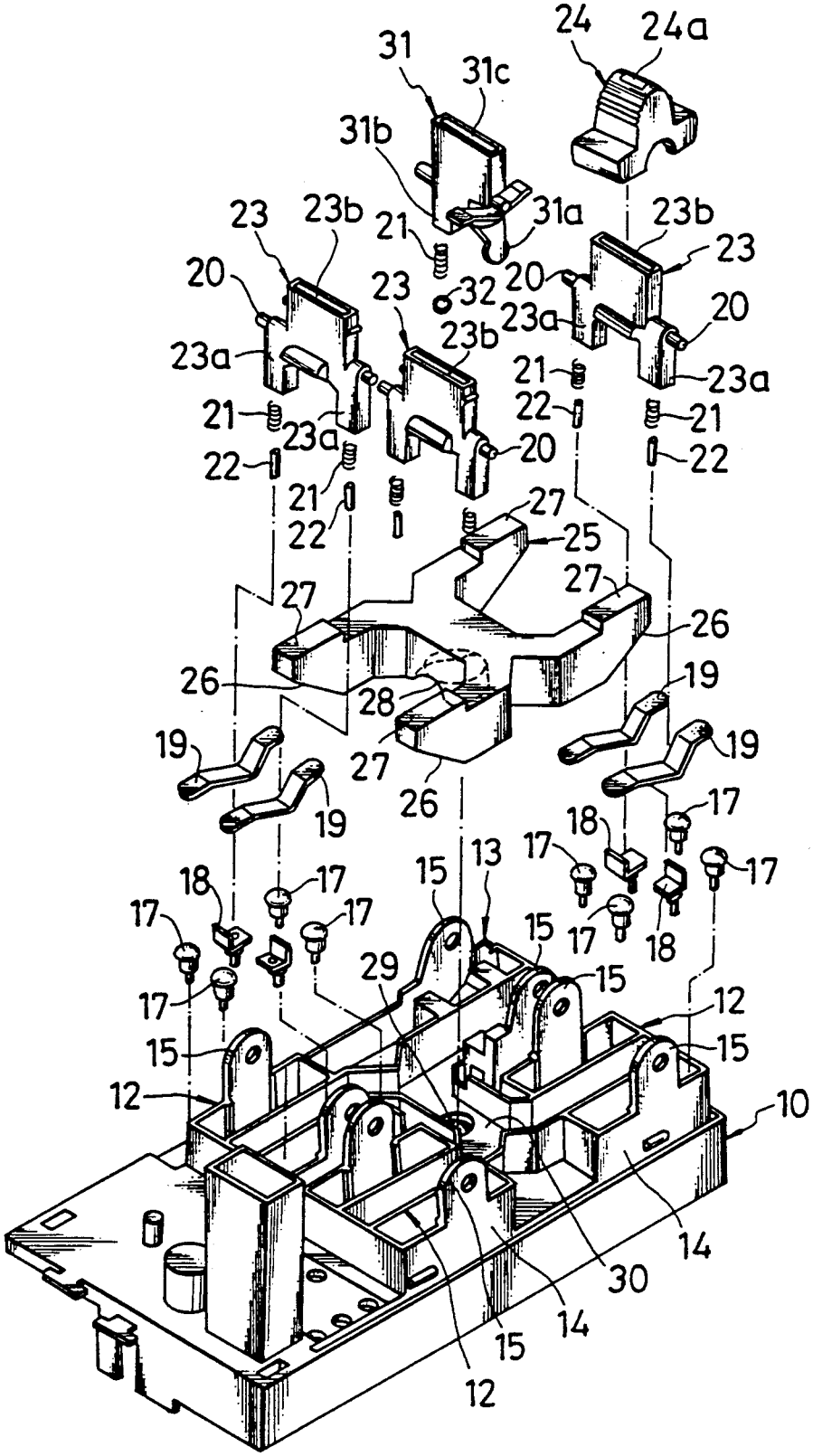
Figure 5:
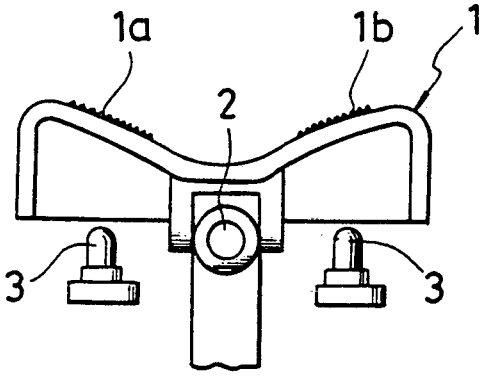
FIG.5 (PRIOR ART)
FIGS. 5 and 6 are respectively explantory views schematically showing a conventional power window switch.
Figure 6:
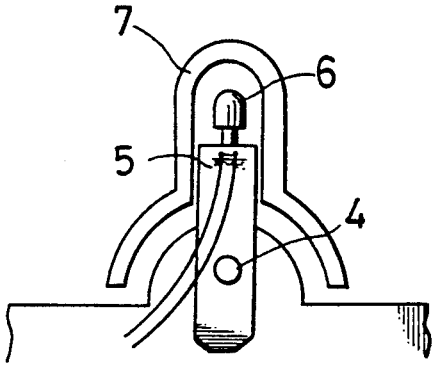
FIG.6 (PRIOR ART)

In the following, the present invention will be described by way of one embodiment with reference to FIGS. 1 to 4.

Referring to FIGS. 1 to 4, reference numeral 10 denotes a case with its cover removed, and a print substrate 11 is disposed in said lower portion. Four switch portions 12, 12, 12 and 13 are disposed on the upper surface of the case 10. These switch portions 12 and 13 are composed of a rectangular portion 14 protruded from the upper surface of the case 10. Bearing portions 15 and 15 protrude from the upper end of the rectangular portion 14. Circular holes 16 are bored in the bottom of the rectangular portion 14. Fixed contacts 17, 17 and a central contact 18 are fitted in said circular hole 16. Movable contacts 19 are bent so as to have a V-shape and having a central portion supported on the central contact 18 and opposite ends disposed to be placed in contact with and away from the fixed contact 17. A switch operating member 23, which is connected to rectangular portions 14 by means of a pin 20 supportd on said bearing portions 15 and 15, contacts drive rod 22 which is received into a lower receiving hole through a spring 21, the drive rod 22 being placed in resilient contact with the upper surface of said movable contact 19. A knob 24 is fitted in the upper portion of the switch operating member 23.

Reference numeral 25 denotes a light conduction body having a plurality of arms, which is formed into an approximately H-shape, each end of each arm being formed into a tapered surface 26 and upper surface which forms a projecting portion 27. Light is directed through from the upper surface of the projecting portion 27. The light conduction body 25 is formed in its central lower surface with a semispherical concave portion 28, within which is disposed a light source 29 such as a lamp. Reference numeral 25*a* denotes a locating pin projected from the lower surface of the light conduction body, and 25*b* denotes a reflecting surface.

The light conduction body 25 is fitted in a recess 30 having an approximately H shape formed so as to provide four rectangular portions 14 . . . . The projecting portion 27 of the light conduction portion 25 is disposed between the pair of movable contacts 19 and 19 of each switch portion 12. On the other hand, the switch operating portion 23 is formed in its opposite lower ends with projecting portions 23*a* and 23*a* and disposed in the form of a forked portion such that the projecting portion 27 of each arm of the light conduction body 25 is disposed between the projections 23*a* and 23*a* being formed with said receiving holes for receiving the spring 21 or the like. The switch operating portion 23 is further bored in its central portion with a vertical light conduction path, for example, a hole 23*b*, said hole 23*b* having a lower opening opposed to the upper surface of the projecting portion 27, said hole 23*b* having an upper opening opposed to an illumination portion 24*a* of the knob 24.

An rocking movable contact is not provided on the switch operating portion 31 of the switch portion 13. However, a lever portion 31*a* for moving a slider not shown, a spring 21 and a projecting portion 31*b* for receiving a steel ball 32 are disposed so as to be disposed on either side of the projecting portion 27 of the light conduction body 25. A through hole 31*c* is bored in the central portion of the switch operating portion 31.

In the embodiment constructed as described above, the light of the light source 29 is received from the recess 28 of the light conduction body 25, and the light is issued from the upper surface of each projecting portion 27 through the reflecting surface 25*a*, the tapered surface 26 and the like. The lower openings of the holes 23*b* and 31*c* of the switch operating members 23 and 31 are opposed to the upper surface of the projecting portion 27. The projecting portion 27 is disposed to direct light through the holes 23B and 21C of the switch operating members 23 and 31 regardless of the rocking position. The issuing light is released from the upper opening along the holes 23*b* and 31*c* from the opening to illuminate the illuminating portion 24*a*. The switch operating members 23 and 31 are rocked and operated as described above. Even in the state where the switch operating members 23 and 31 are tilted to the maximum, the lower openings of the holes 23*b* and 31*c* are opposed to the upper surface of the projecting portions 27 to receive the issuing light, thus maintaining sufficient quantities of light.

Furthermore, the light of the single light source 29 can be guided by the light conduction body 25 into the plurality of switch portions 12 and 13. Therefore, it is not necessary to provide a light source on each switch portion and to provide wiring therefor as in prior art, thus simplifying the construction and improving the reliability. As for the light source, one capable of being replaced can be used, thus rendering replacement easy.

While in the above-described embodiment, a hole has been made as a light conduction path, it is to be noted that the present invention is not limited thereto but a transmissive material may be used.

As described above, according to the present invention, the construction of apparatus can be simplified, the reliability is improved, and the light source can be replaced.

What is claimed is:

1. An illuminating switch apparatus comprising:

a case 10;

a light source 29 disposed on said case 10;

a plurality of switches 12, 13 disposed on said case 10 and spaced from said light source 29, each of said plurality of switches 12, 13 comprising a bearing portion 15 and switch operating members 23, 31 pivotally disposed on said bearing portions 15 about an axis, said switch operating members 23, 31 defining light conducting paths 23*b*; and a light conducting body 25 disposed on said case 10 comprising a plurality of arms extending from a point adjacent said light source 29 to said switch operating members 23, 31, said arms having an upper surface projecting portion 27 and at least one reflecting surface 25*a*, 26 such that light from said light source 29 is reflected by said at least one reflecting surface 25*a*, 26 and through said upper surface projecting portion 27 such that said light is directed through said light conduction paths 23*b*.

2. An apparatus of claim 1 wherein said each of said switch operating members 23, 31 comprises an elongated structure disposed radially from said axis, said light conduction paths 23*b* extending through said elongated structure from a first point adjacent said bearing portions 15 to a second point at an extreme end of said elongated structure.

3. An apparatus of claim 2 wherein each of said plurality of switches 12, 13 further comprise a pair of projecting portions 23*a* spaced to define a gap therebetween, said gap being disposed adjacent said light conducting paths 23B such that said upper surface projecting portion 27 is disposed between said projecting portions 23*a*.

4. An apparatus of claim 1 wherein the number of switches 12, 13 illuminated by said light source 29 is three or more.

* * * * *